United States Patent [19]

Petersson, deceased et al.

[11] 4,345,881

[45] Aug. 24, 1982

[54] CLOSE-OFF VALVE FOR SUCTION PIPES IN HYDRAULIC PUMPS

[75] Inventors: Ralf K. E. Petersson, deceased, late of Hudiksvall, Sweden; by Stephan Vejdemo, executor, Huddinge, Sweden

[73] Assignee: Sundins Fabriker AB, Hudiksvall, Sweden

[21] Appl. No.: 117,346

[22] Filed: Jan. 31, 1980

[51] Int. Cl.[3] ..... F04B 1/18; F04B 39/10

[52] U.S. Cl. ..... 417/270; 417/295; 417/507

[58] Field of Search ..... 417/269, 270, 507, 295

[56] References Cited

U.S. PATENT DOCUMENTS

| | | | |
|---|---|---|---|
| 744,547 | 11/1903 | Hill | 417/507 |
| 3,067,694 | 12/1962 | Fancher | 417/269 |
| 3,085,514 | 4/1963 | Budzich | 417/269 |
| 3,156,410 | 11/1964 | Le Riche | 417/440 |
| 3,411,453 | 11/1968 | Chanal | 417/269 |
| 4,067,484 | 1/1978 | Standlich | 417/507 |
| 4,275,998 | 6/1981 | Petersson | 417/269 |

FOREIGN PATENT DOCUMENTS

| | | | |
|---|---|---|---|
| 553938 | 1/1957 | Italy | 417/441 |

*Primary Examiner*—William L. Freeh

*Attorney, Agent, or Firm*—Harness, Dickey & Pierce

[57] ABSTRACT

A close-off valve for suction pipes to establish communication between a source of pressure and a consumer of pressure, such as a hydraulic pump. The valve makes it possible to disconnect the consumer in a simple and reliable manner, that is without leakage of the pressure, in addition to which it allows a liquid, such as oil, in certain quantities to flow through the valve above the valve disc, when the latter assumes the position in which it closes the outlet of the valve. For this purpose the valve comprises a solenoid valve which controls a flow of pressurized air to the valve housing in order to actuate the valve disc closing off said communication. In addition, the valve is arranged with through-passage means above said disc in order to allow passage-through of a certain amount of liquid, when the valve disc is in its closing position.

3 Claims, 3 Drawing Figures

CLOSE-OFF VALVE FOR SUCTION PIPES IN HYDRAULIC PUMPS

BACKGROUND OF THE INVENTION

The invention generally relates to an improvement in close-off valves in suction lines of the kind comprising a valve housing in which a spring-loaded piston is movably mounted. The rod of the piston supports a valve disc which is arranged to move into a position in engagement with a valve seat for the purpose of shutting-off a suction line.

The purpose of the invention is to provide a close-off valve, which is arranged, while shutting-off a flow of a medium, such as a hydraulic fluid from the source to the consumer, e.g. a hydraulic pump, to allow a small flow of the hydraulic fluid, thus effecting lubrication and to some extent cooling of the hydraulic pump when the latter is running idle, that is when the valve disc is in its position abutting against its valve seat to close off the main passageway through the valve.

More precisely, the invention relates to an improved close-off valve for suction pipes in hydraulic pumps of the kind comprising a hydraulic piston system which is controlled by a tilting disc in order to generate a flow of a hydraulic medium in the main passageway. The tilting disc abuts against a thrust bearing and in the pump housing is provided also a laterally directed passageway allowing passage-through of a small amount of oil which is sufficient to lubricate and cool the pump. The valve disc which is supported by the piston rod of the spring-loaded piston, which is movably mounted in the valve housing, is arranged to be controlled by a solenoid valve and to be moved into abutment against a valve seat for the purpose of shutting off the connection means to the main passageway of the pump.

SUMMARY OF THE INVENTION

In accordance with the teachings of the subject invention this purpose is achieved in that a cavity is provided above the valve disc so as to serve to communicate the various parts of the connection means with one another and also to communicate a connection line leading from the lateral passageway with the outlet of said connection means, thus allowing oil to flow from an oil reservoir, around the thrust bearing, the tilting disc and through said lateral passageway, said cavity above the valve disc and the outlet of the connection means in order to lubricate the thrust bearing of the pump and the tilting disc and to cool the pump, when said valve disc is in the position wherein it shuts off communication between the various parts of said connection means.

BRIEF DESCRIPTION OF THE DRAWINGS

The invention will be described in closer detail in the following with reference to the accompanying drawings, wherein.

DETAILED DESCRIPTION OF A PREFERRED EMBODIMENT

Figure 1:
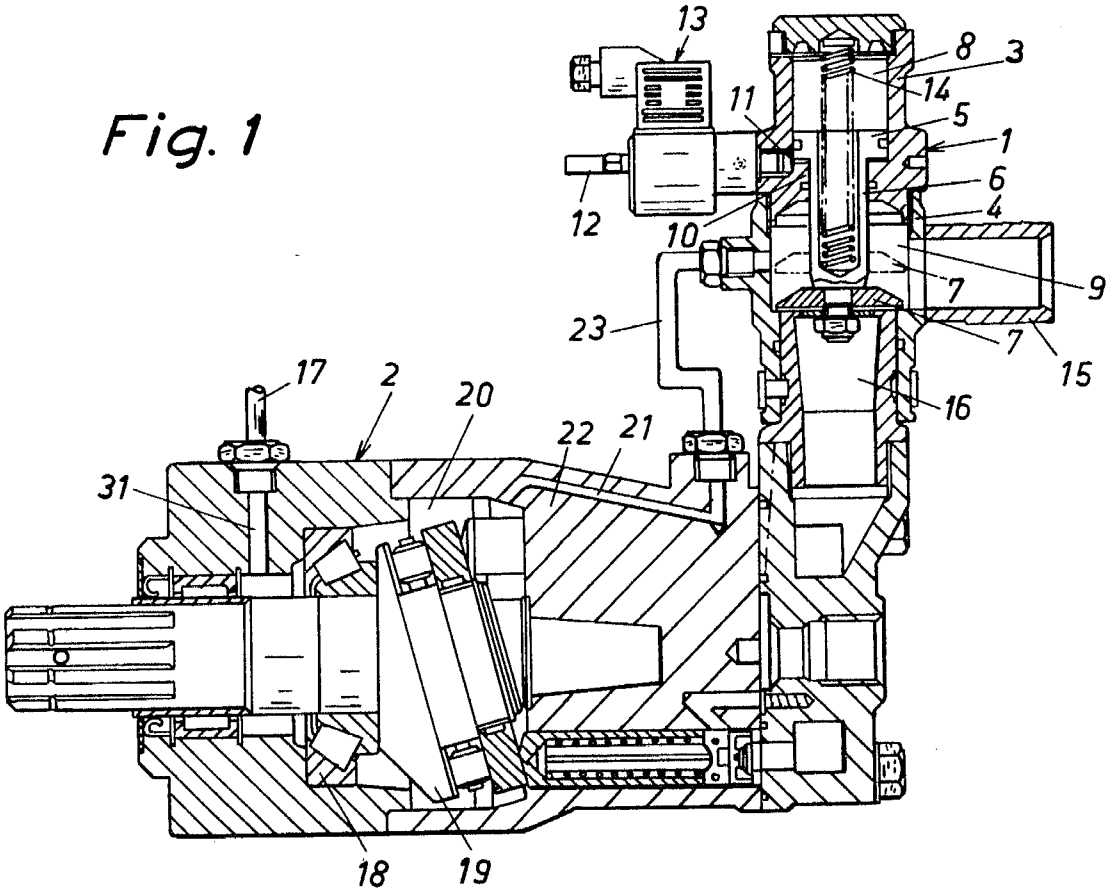
FIG. 1 illustrates a first embodiment of the valve in accordance with the invention, when connected to a hydraulic pump.

FIG. 1 illustrates in a cross-sectional view a valve 1 in accordance with the invention when connected to a hydraulic pump 2. The supply of hydraulic fluid to the pump 2 is controlled by the valve 1. The valve 1 comprises two parts 3 and 4 forming a housing in which a piston 5 is movably mounted. The piston 5 has an extension 6 which supports a valve disc 7. The piston 5 is movable in a chamber 8 and this movement of the piston 5 causes displacement of the valve disc 7 in a cavity 9. On the inner face of the housing 3, 4 is arranged a shoulder 10, whereby a cavity 11 is formed between the piston 5 and the shoulder 10, into which cavity, e.g. compressed air may be supplied from a line 12 while being controlled by a solenoid valve 13. The solenoid valve 13 is of a well known type and therefore need not be described in closer detail here.

The piston 5 is actuated by a spring 14 which tends to urge the piston 5 to a position wherein the valve disc 7 abuts against its seat and in which the inlet (the pipe socket 15) is closed. Consequently, hydraulic fluid is prevented from flowing through the outlet 16. Pressurized air may be fed through the line 12 into the cavity 11, resulting in displacement of the valve disc 7 to the position indicated in dash-and-dot lines, whereby the main passageway through the valve 1 is opened.

In the embodiment illustrated, the valve 1 is connected to a hydraulic pump 2, which in the manner indicated is provided with a pipe 17 to connect it to a reservoir container (reference numeral 27 in FIG. 3) holding a hydraulic fluid. The hydraulic pump includes a thrust bearing 18 and a tilting disc 19 and when said bearing and said disc are made to rotate, as they are when the hydraulic pump is in operation, a partial vacuum is generated forcing hydraulic fluid to flow from the line 17 through a channel 31 to the cavity 20 occupied by details 18, 19, and further through a line 21 in the pump unit 22 to the outlet line 23 to be supplied to the valve 1. In the open position of the valve 1, hydraulic fluid is sucked down into the outlet 16, whereas when the valve is closed, the flow of fluid from the line 23 will be through the pipe socket 15. This means that lubrication of the hydraulic motor is provided not only during the pump operation but also while it is running idle. In addition, this continual flow of lubricating medium is sufficient to lower the temperature of the pump to some extent in addition to which the lubrication has the positive effects of not only preventing overheating of the pump but also of giving noiseless operation thereof.

Figure 2:
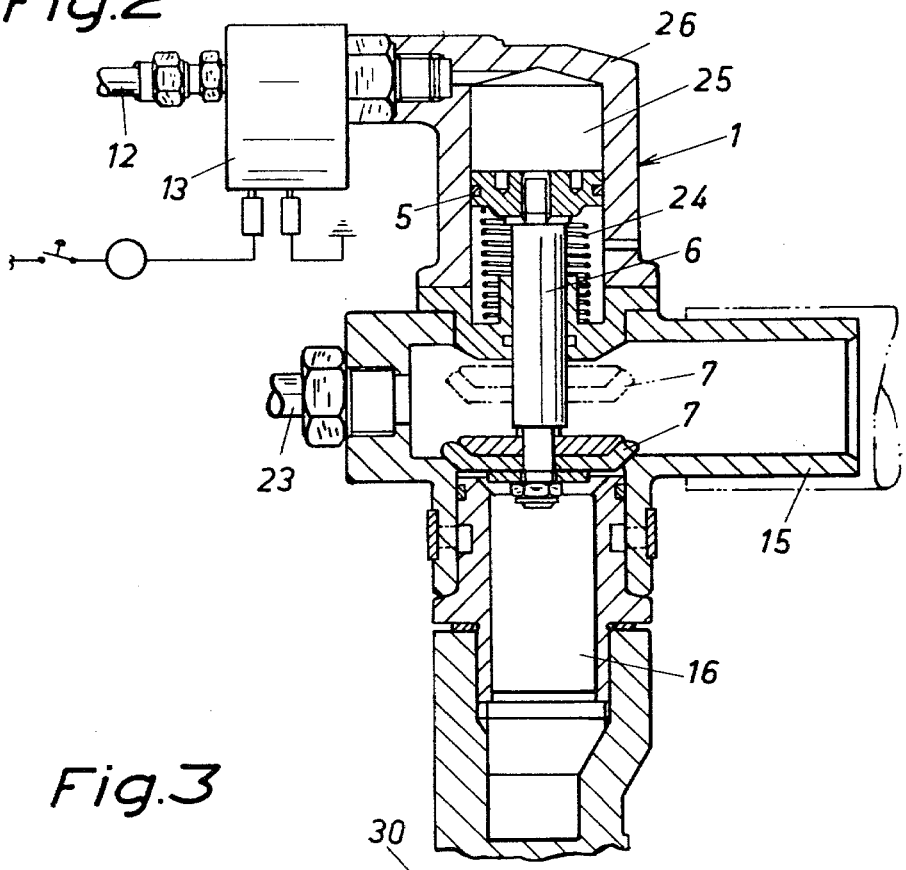
FIG. 2 illustrates a modified embodiment of the valve of the invention.

FIG. 2 shows a modified embodiment according to which a spring 24 tends to move the piston 5 to the open position shown by the position of the valve disc 7, indicated in dash-and-dot lines. In this case shutting of the valve 1 thus is effected with the aid of pressurized air which is forced from the line 12 into an upper cavity 25 formed in the valve housing 26. Also in this case oil or some other hydraulic fluid is allowed to flow through the line 23 both when the valve 1 is in its open and in its closed positions in the manner explained above.

Figure 3:
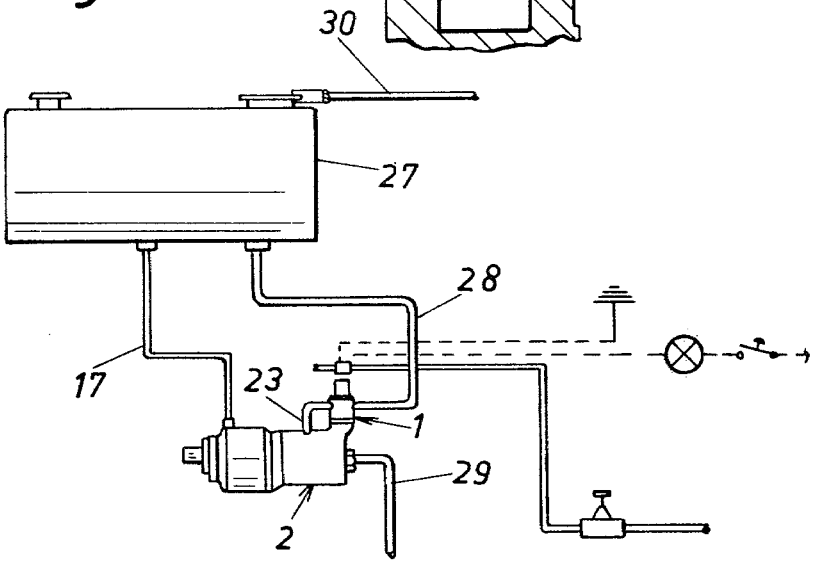
FIG. 3 illustrates the valve in accordance with the invention arranged in a hydraulic pump and connected in a hydraulic circuit.

FIG. 3 shows the valve 1 and the pump 2 when inserted in a hydraulic pipe system including a reservoir container 27 and communicating lines 17, 23 between the pump and the container 27 as well as between the pump 2 and the valve 1. In addition, this drawing figure indicates the provision of a line 28 from the valve 1 to the container 27 and a line 29 from the pump to the consumer of the hydraulic fluid under pressure as well as the provision of a return pipe 30 from this consumer. In addition, the drawing figure suggests a system designed to feed compressed air with the aid of the solenoid valve.

The invention is not limited to the embodiments shown and described in the aforegoing but modifications are possible within the scope of the appended claims. It goes without saying that the valve could be used in other positions and applications than those suggested herein, particularly when it is desired to be able to close off a flow of liquid from a pump or similar means to remove the pump for repair, service or exchange.

What I claim is:

1. An improved close-off valve for suction pipes between a reservoir and a hydraulic pump, said pump being of the kind comprising a hydraulic piston system, a main passageway adapted to selectively communicate with said reservoir, a tilting disc for operating said hydraulic piston system for generating a flow of a hydraulic fluid from the reservoir through the said main passageway to said pump, a thrust bearing supporting said tilting disc, and a bypass passageway provided in the pump housing and passing across said tilting disc and said thrust bearing to allow passage through of a small amount of oil, said small amount of oil being sufficient to lubricate and cool the pump, said close-off valve comprising a valve housing, a spring-loaded piston movably mounted in said valve housing and operatively connected to a rod, a valve disc supported by said rod, a solenoid valve controlling the movement of said valve disc, said valve disc arranged to be moved into abutment against a valve seat for the purpose of shutting off the connection of said reservoir to said main passageway of the pump, the improvement comprising a cavity in said valve housing between said reservoir and said valve seat, said cavity being in continuous communication with the reservoir and with said bypass passageway regardless of the position of said valve disc for allowing oil to flow from the reservoir around said thrust bearing and said tilting disc and further through said bypass passageway to lubricate said thrust bearing of the pump and said tilting disc to cool the pump even when said valve disc is in the closed position.

2. An improved valve as claimed in claim 1, comprising a valve operating cavity between said piston and a shoulder formed in the interior of said valve housing, said solenoid valve controlling an air flow to said valve operating cavity in order to displace said piston against the action of said spring in order to lift said valve disc for the purpose of opening said communication.

3. An improved valve as claimed in claim 1, comprising a valve operating cavity formed between one end wall of said valve housing and said piston, said solenoid valve arranged to control an air flow to said valve operating cavity for the purpose of forcing said piston against the action of said spring to a position, wherein said valve disc abuts against said valve seat, thus interrupting communication through said close-off valve.

* * * * *